US006751976B2

(12) United States Patent
Lowes

(10) Patent No.: US 6,751,976 B2
(45) Date of Patent: Jun. 22, 2004

(54) HEAT PUMP EQUIPMENT

(75) Inventor: Albert Robert Lowes, Devon (GB)

(73) Assignee: Eaton-Williams Group Limited, Kent (GB)

( * ) Notice: Subject to any disclaimer, the term of this patent is extended or adjusted under 35 U.S.C. 154(b) by 111 days.

(21) Appl. No.: 09/974,813

(22) Filed: Oct. 12, 2001

(65) Prior Publication Data

US 2002/0162348 A1 Nov. 7, 2002

(30) Foreign Application Priority Data

Oct. 13, 2000 (GB) ..... 0025122
Dec. 1, 2000 (GB) ..... 0029307

(51) Int. Cl.[7] ..... F25B 13/00; F25B 1/00
(52) U.S. Cl. ..... 62/324.6; 62/160
(58) Field of Search ..... 62/324.6, 160, 62/238.7; 165/104.21, 104.22

(56) References Cited

U.S. PATENT DOCUMENTS 4,498,295 A * 2/1985 Knoos ..... 60/517
4,646,538 A * 3/1987 Blackshaw et al. ..... 62/238.7
4,949,553 A * 8/1990 Suzuki ..... 62/238.7
5,243,825 A * 9/1993 Lin ..... 62/238.7
5,711,163 A * 1/1998 Uchikawa et al. ..... 62/324.6
5,771,699 A 6/1998 Ponder

FOREIGN PATENT DOCUMENTS

JP 6257902 9/1994
JP 406272996 A * 9/1994 ..... 165/240

OTHER PUBLICATIONS

Gieck K., Gieck R.; "Technische Formelsammlung"; 1989, Gieck, Germering, D, XP002208552; p. S10 (copy of ISR attached).

* cited by examiner

*Primary Examiner*—Melvin Jones
(74) *Attorney, Agent, or Firm*—Clark & Brody

(57) ABSTRACT

Heat pump equipment comprising at least three heat exchangers, one of which is intended to be located in an enclosed region and the other two of which are intended to be located outside the enclosed region. Each heat exchanger has a delta connection end connected in heat-exchange fluid communication with a delta arrangement. The delta connection end of each heat exchanger is connected to both of the delta connection ends of the other two heat exchangers via the delta arrangement. There are three fluid-expansion devices, one between the two connections of each pair of adjacent connections of the heat exchangers to the delta arrangement.

The present invention extends to heat pump equipment comprising at least three heat exchangers connected in a heat-exchange fluid circuit, one of which heat exchangers is intended to be located in an enclosed region and another of which is intended to be located outside the enclosed region. A third one of the heat exchangers is arranged so that air which flows through an aperture in a wall which forms a boundary of the enclosed region passes over the said third heat exchanger.

13 Claims, 3 Drawing Sheets

HEAT PUMP EQUIPMENT

TECHNICAL FIELD

The present invention relates to heat pump equipment.

BACKGROUND ART

In previously proposed heat pump equipment, means have been provided to enable heat exchangers outside a building to be defrosted even while the equipment is being used to transfer heat from outside the building into its interior, in the form of more than one pressure drop and complex solenoid operated valve systems. This has made the equipment relatively expensive, and, because of its complexity, relatively difficult to diagnose any malfunction occurring within the equipment.

SUMMARY OF THE INVENTION

A first aspect of the present invention seeks to obviate this disadvantage.

Accordingly, a first aspect of the present invention is directed to heat pump equipment comprising at least three heat exchangers, one of which is intended to be located in an enclosed region and the other two of which are intended to be located outside the enclosed region, in which each heat exchanger has a delta connection end connected in heat-exchange fluid communication with a delta arrangement, such that the delta connection end of each heat exchanger is connected to both of the delta connection ends of the other two heat exchangers via the delta arrangement, in which arrangement there are three fluid-expansion devices, one between the two connections of each pair of adjacent connections of the heat exchangers to the delta arrangement.

Such equipment has the advantage that heat-exchange fluid can be directed to flow from the two outside heat exchangers to the inside heat exchanger, or alternatively from the inside heat exchanger to the two outside heat exchangers, and for defrosting of either one of the outside heat exchangers, fluid can be directed to flow from both that one of the outside heat exchangers and the inside heat exchanger to the other outside heat exchanger via the delta arrangement.

To achieve this, there is preferably one compressor connected to receive heat-exchange fluid from and to feed heat-exchange fluid to the heat exchangers via a valve arrangement.

The valve arrangement may comprise a valve for each heat exchanger. Each valve may be a four-way valve.

Equipment embodying this first aspect of the present invention may be easier to service than previously proposed equipment. Use of the gas phase to effect defrosting of the outside coils allows defrost rates to be unaffected by gravity especially defrost rates of each path of multiple path heat exchangers if these are used. This speeds defrosting by an even distribution of heat. The path length does not need to be reduced when one of the outside heat exchangers is defrosted. This increases the maximum performance in the event that a refrigerant with a glide is used.

DETAILED DESCRIPTION OF THE PREFERRED EMBODIMENTS

Figure 1:
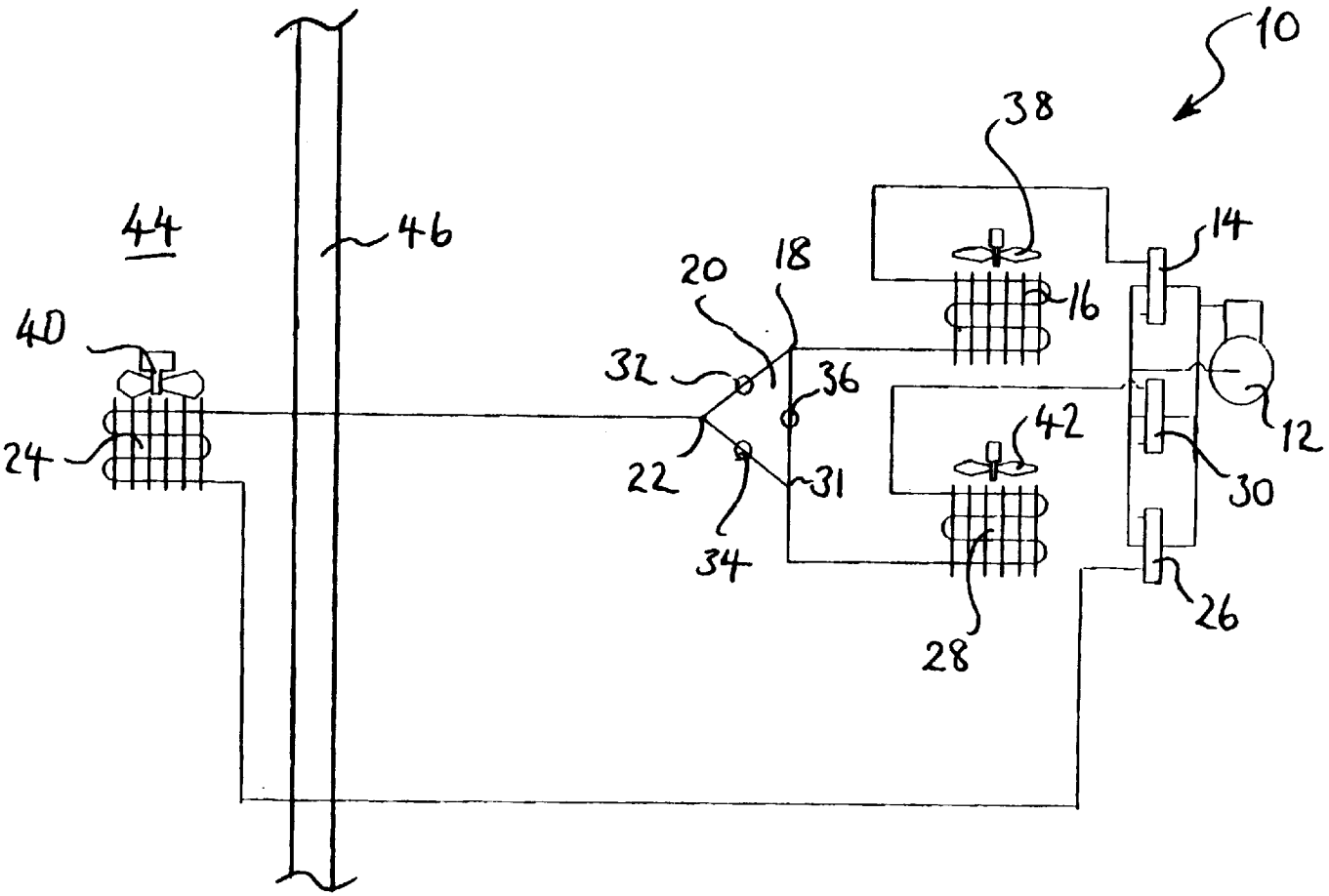
FIG. 1 is a schematic of a first embodiment of the invention.

An example of heat pump equipment embodying the first aspect of the present invention is illustrated in FIG. 1 of the accompanying drawings which shows, diagrammatically, a fluid circuit of the equipment.

The heat exchange equipment 10 shown in FIG. 1 comprises a compressor 12 having its fluid output connected via a four-way valve 14 to a heat-exchange coil 16 at one end thereof, the other end of which is connected to an apex 18 of a delta arrangement 20. A second apex 22 of the delta arrangement 20 is connected to one end of a fluid exchange coil 24, the other end of which is connected to the input end of the compressor 12 via a four-way valve 26.

The output of the compressor 12 is also connected to one end of a heat-exchange coil 28 via a third four-way valve 30, and the other end of the heat-exchange coil 28 is connected to a third apex 31 of the delta arrangement 20.

There is a first expansion device 32 between the apices 18 and 22 of the delta arrangement, a second expansion device 34 between the apices 22 and 31 of the delta arrangement 20, and a third expansion device 36 between the apices 18 and 31 of the delta arrangement 20.

The heat-exchange coils 16, 24 and 28 are provided with respective fans 38, 40 and 42. These are arranged to direct air to flow over their respective coils.

The heat-exchange coil 24 is located within an enclosed region 44, whilst the coils 16 and 28 are located outside of the enclosed region 44. A wall 46 of the region 44 creates an outside boundary between the enclosed region 44 and outside regions.

With the arrangement connected in this way, the compressor 12 drives hot gases through the valves 14 and 30 into the exterior heat-exchange coils 16 and 28. As the hot gaseous heat-exchange fluid flow through the heat-exchange coils 16 and 28, it is cooled by the outside air, and this cooling is assisted by the operation of the fans 38 and 42 to result in condensation of the heat-exchange fluid in those coils. The liquid heat-exchange fluid from the heat-exchange coil 16 passes to the apex 18 of the delta arrangement 20 through the expansion device 32 to the apex 22 and from thence to one end of the heat-exchange coil 24. Likewise, the liquid heat-exchange fluid from the heat-exchange coil 28 flows from one end thereof to the apex 31 of the delta arrangement 20, through the expansion device 34 to the apex 22 and again onwards to the heat-exchange coil 24. Thus, it will be seen that liquid from the coils 16 and 28 meets at the apex 22. Because there is substantially no differential pressure across the expansion device 36 in this condition of the heat pump equipment, substantially no fluid flows between the apices 18 and 31 of the delta arrangement 20, so that in this particular condition of the heat pump equipment, it is as if there were no connection between those apices. At the heat-exchange coil 24, the liquid is warmed by the air within the enclosed region 44, and this exchange is assisted by the fan 40. It results in the cooling of the air in the enclosed region 44. After flowing through the heat-exchange coil 24, the heat-exchange fluid returns back to the compressor 12 via the four-way valve 26.

The valves 14, 26, and 30 may be switched so that the output of the compressor 12 is now connected via the four-way valve 26 directly to the heat-exchange coil 24. The hot gaseous heat-exchange fluid is cooled in this coil 24 by the air within the enclosed region 44, which heat-exchange is assisted by the fan 40, so that the air in the enclosed region 44 is heated. The heat-exchange fluid continues from the coil 24 to the apex 22 of the delta arrangement 20 where it divides, some of it passing through the expansion device 32 and some of it passing through the expansion device 34. From these expansion devices, the fluid continues to the two outside heat-exchange coils 16 and 28 where the fluid is warmed and evaporated by the outside air, this heat-exchange being assisted by the fans 38 and 42 respectively. This effectively cools the outside area. Heat-exchange fluid from the coils 16 and 28 in this condition of the equipment then passes respectively to the four-way valves 14 and 30 and thence to the input of the compressor 12. Once again, in this condition of the equipment there is substantially no pressure differential across the apices 18 and 31 of the delta arrangement 20, so that no fluid flows between these apices and it is as if they were disconnected.

Continued operation of the heat-exchange equipment in this second condition may ultimately result in the heat-exchange coils 16 and 28 becoming frosted up on their exteriors, resulting in reduced efficiency of the heat-exchange equipment. To remedy this, it is necessary for the coils to be warmed. Normally, this would prevent the heating effect of the heat pump equipment on the air of the enclosed region. However, with the delta arrangement described herein, it is possible to switch the valves 14, 26 and 30 so that the output of the compressor 12 is connected to deliver hot gaseous heat-exchange fluid to one of the outside coils, say, coil 16, as well as to the inside coil 24. The fan 38 associated with that coil 16 would then be switched off. As a result, the heat-exchange fluid gives out heat from both of these coils 24 and 16, although the fan 40 might be slowed in its rotational speed to take account of the fact that some of the heat from the fluid delivered by the compressor 12 is now passing out from the coil 16. Fluid from both the coils 24 and 16 reach the delta arrangement 20 at apices 22 and 18, respectively, and from thence pass through the expansion devices 34 and 36, respectively, before merging at the apex 31 of the delta arrangement 20. From here, the fluid flows through the coil 28 where it is heated and evaporated by the outside air. This heat-exchange is again assisted by the fan 42. The heat-exchange fluid continues on its course through the valve 30 and thence back to the compressor 12 on the input side thereof.

In this third condition of the equipment, the pressure differential across the apices 18 and 22 is substantially zero so that substantially no fluid flows between those apices and it is as if they were disconnected and as if the expansion device 32 were absent.

In a fourth switching condition of the heat pump equipment, the valves 14, 30 and 26 are arranged so that the compressor 12 feeds hot gaseous heat-exchange fluid from its output to the coils 24 and 28 via the valves 26 and 30, respectively. The fan 42 associated with the coil 28 would then switched off. The fluid continues to the delta arrangement 20 reaching it at apices 22 and 31 from where it flows through the expansion devices 32 and 36, respectively, and thence to merge at apex 18, from which it flows to the coil 16 via the four-way valve 14 back to the input of the compressor 12. In this condition of the heat pump equipment, the air of the enclosed region 44 is still heated, but the coil 28 is defrosted and the coil 16 is used to do all the heating of the heat-exchange fluid.

It will be appreciated that one of the ports of each four-way valve is blocked off.

In the event that the four-way valves are solenoid operated, the de-energised conditions are such that in the event that they are all de-energised, the compressor 12 is nonetheless connected to a viable circuit.

Numerous variations and modifications to the equipment illustrated in FIG. 1 will occur to the reader without taking the resulting construction outside the scope of the first aspect of the present invention. For example, whilst the delta arrangement 20 is illustrated as a triangular form, the delta is not to be taken as requiring the appearance of a triangle. It could be circular, or indeed it could have any other form provided it is topographically equivalent. The refrigerant may be provided with a glide. The expansion devices may comprise orifice or capillary devices or any other form of expansion device and may or may not be connected in parallel with respective bi-directional or one-way valves as appropriate. The heat exchangers may be multiple path or single path heat exchangers.

In the event that the equipment illustrated in FIG. 1 is for heating the air of the enclosed area only, for example, it is not necessary to provide the four-way valves.

Whilst the enclosed region has been described with reference to FIG. 1 as being filled with air, in other applications it might be filled with a different fluid, for example water.

Heat pump equipment previously proposed has operated in a relatively inefficient way, for example, endeavouring to cool heat-exchange fluid by air that is already hot, or conversely in endeavouring to warm hot heat-exchange fluid with air that is already cool.

A second aspect of the present invention seeks to provide a remedy.

Accordingly, a second aspect of the present invention is directed to heat pump equipment comprising at least three heat exchangers connected in a heat-exchange fluid circuit, one of which heat exchangers is intended to be located in an enclosed region and another of which is intended to be located outside the enclosed region, and the third one of the heat exchangers is arranged so that air which flows through an aperture in a wall which forms a boundary of the enclosed region passes over the said third heat exchanger.

Preferably, the said third heat exchanger lies outside the enclosed region.

It is desirable to locate an expansion device between the said another heat exchanger and the said third heat exchanger. Desirably, there is a further expansion device connected between the said third heat exchanger and the said one heat exchanger. Preferably, each expansion device is connected in parallel with an associated one-way valve, each allowing flow in a direction towards the said third heat exchanger. It is desirable for a compressor to be connected between the said one heat exchanger and the said another heat exchanger, preferably via a reversing valve to provide greater flexibility for the equipment.

An air filter may be provided in the said aperture. The air filter may be kept dry by the said third heat exchanger.

The said second aspect of the present invention may be combined with the said first aspect of the present invention so that in addition to the heat exchangers referred to with reference to the first aspect of the present invention, a fourth heat exchanger is provided, being the said third heat exchanger with reference to the second aspect of the present invention.

Figure 2:
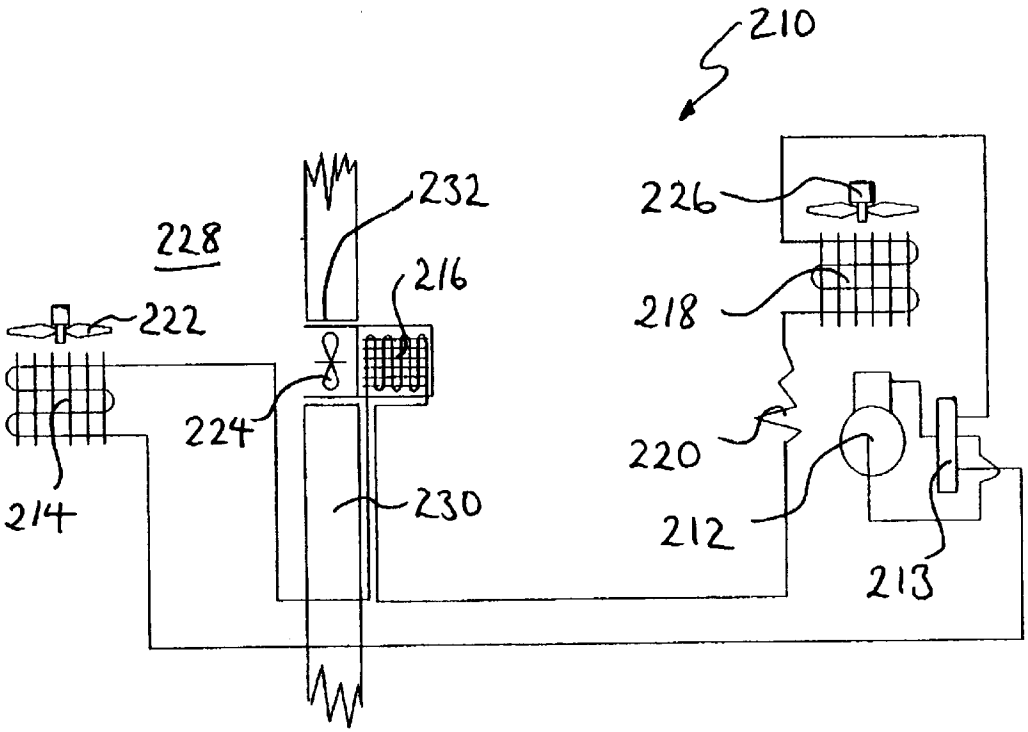
FIG. 2 is a schematic of a second embodiment of the invention.
Figure 3:
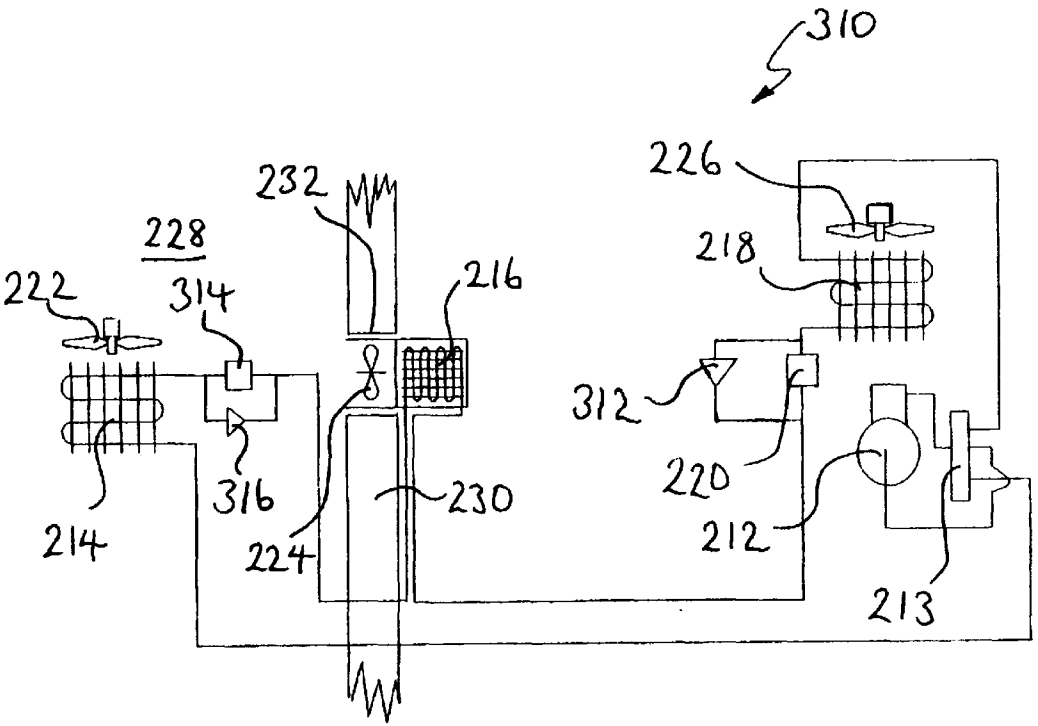
FIG. 3 is a schematic of a third embodiment of the invention.

Examples of the second aspect of the present invention are shown in FIGS. 2 and 3 which show respective diagrammatic fluid circuits of two such examples.

The heat pump equipment 210 shown in FIG. 2 comprises a compressor 212, the output of which is connected to one end of a heat-exchange coil 214 via a reversing valve 213. The other end of the coil 214 is connected to one end of a further heat-exchange coil 216, the other end of which is connected to a further heat-exchange coil 218 via an expansion device 220. The other end of the heat-exchange coil 218 returns back to the input side of the compressor 212 via the reversing valve 213. Fans 222, 224 and 226 are arranged to blow air over or draw air over the coils 214, 216 and 218, respectively.

The coil 214 is located within an enclosed region 228. The coil 218 is outside this enclosed region, and a wall 230 forms a boundary for the enclosed region 228. The fan 224 is positioned within an aperture 232 in the wall 230, and the coil 216 is located adjacent to the aperture 232 on the outer side of the wall 230 so that the fan 224 draws air over the coil 216.

With the heat pump equipment 210 so arranged, in a first condition of the equipment hot gaseous heat-exchange fluid is pumped from the compressor 212 to the coil 214 where it is cooled and condensed by the interior air with the assistance of the fan 222, which air thereby becomes warmed. The heat-exchange fluid continues through the coil 216 to give up further heat to air which flows in through the aperture 232 in the wall 230 with the assistance of the fan 224. This ensures that fresh air entering the building is already slightly warmed. The condensed heat-exchange fluid continues to the expansion device 220 and thence to the coil 218 where it draws in heat from the surrounding air with the assistance of a fan 226. This causes the heat-exchange fluid to evaporate. From the coil 218, it returns to the input suction end of the compressor 212 via the reversing valve 213. In this condition, the heat pump equipment warms the air of the enclosed region and at the same time ensures in an efficient way that air from the outside entering the building via the aperture 232 is warmed a little.

By switching the reversing valve 213, hot gaseous heat-exchange fluid from the compressor 212 can be passed to the coil 218 where it is condensed, heat passing to the outside air. From there the fluid is cooled at the expansion device 220 and passes to the coil 216 where the air drawn in to the aperture 232 by the fan 224 is slightly cooled before entering the enclosed region 228. The heat-exchange fluid continues through the coil 214 where heat is drawn in from the air of the enclosed region 228. The heat-exchange fluid then flows back to the input side of the compressor 212 via the reversing valve 213.

In this condition of the heat-exchange equipment 210, the air of the enclosed region 228 is cooled, and fresh air entering through the aperture 232 from the outside is cooled a little before it enters the enclosed region 228.

The heat pump equipment 210 shown in FIG. 2 can be modified to become the heat pump equipment 310 shown in FIG. 3. This equipment has all the components of the equipment shown in FIG. 2, and like parts are labelled with the same reference numerals. In addition, the equipment 310 shown in FIG. 3 has a one-way valve 312 connected in parallel with the expansion device 220 so that its allowed flow direction is from the coil 218 to the coil 216. In addition, a further expansion device 314 is connected between the coil 214 and the coil 216, and a one-way valve 316 is connected in parallel with the expansion device 314 so that its allowed direction of flow is from the coil 214 to the coil 216.

During operation, the equipment 310 shown in FIG. 3 operates in the same way as FIG. 2 when the heat-exchange fluid flows in a clockwise direction, that is to say, from the compressor 212 to the coil 214 and then back via the coils 216 and 218, to warm the air in the enclosed region 228.

However, when the heat-exchange fluid flows in the other direction by reversal of the reversing valve 213, the expansion device 220 is bypassed as the fluid flows preferentially through the one-valve 312, and when it passes from the coil 216 to the coil 214, because it would be flowing in the wrong direction for the one-way valve 316, it flows preferentially through the expansion device 314. When the equipment 310 is in this condition, the air inside the enclosed region 228 is cooled, whilst at the same time heat is given out from the coil 216 and may thereby be used to keep any filter 318 placed within the aperture 232 in a dry condition.

With the equipment thus arranged and in the second condition of operation, reversal of the direction of flow of the fan 224 will pass cool air from the interior of the enclosed region 228 over the coil 216. This first cools the heat exchanger fluid in the coil 216 before it reaches the expansion device 314, and improves the cooling capacity of the equipment.

Numerous variations and modifications to the equipment shown in FIG. 2 or FIG. 3 may occur to the reader without taking the resulting construction outside the scope of the second aspect of the present invention. For example, one or more of the heat exchangers may be multiple path heat exchangers.

What I claim is:

1. Heat pump equipment comprising at least three heat exchangers, one of which is intended to be located in an enclosed region and the other two of which are intended to be located outside the enclosed region, wherein the equipment further comprises a delta arrangement, and each heat exchanger has a delta connection end connected in heat-exchange fluid communication with the delta arrangement, such that the delta connection end of each heat exchanger is connected to both of the delta connection ends of the other two heat exchangers via the delta arrangement, in which arrangement there are three fluid-expansion devices, one between the two connections of each pair of adjacent connections of the heat exchangers to the delta arrangement.

2. Equipment according to claim 1, wherein there is one compressor connected to receive heat-exchange fluid from and to feed heat-exchange fluid to the heat exchangers, and a valve arrangement connected between the compressor and the heat exchangers.

3. Equipment according to claim 2, wherein the valve arrangement comprises a valve for each heat exchanger.

4. Equipment according to claim 3, wherein each valve is a four-way valve.

5. Heat pump equipment comprising at least three heat exchangers connected in a heat-exchange fluid circuit, a wall having an aperture therein and forming a boundary between an enclosed region and a region outside said enclosed region, one of said heat exchangers being located in said enclosed region, another of said heat exchangers being located in said region outside said enclosed region, and a third one of said heat exchangers being arranged so that air which flows through said aperture in said wall passes over said third one of said heat exchangers.

6. Equipment according to claim 5, wherein said third one of said heat exchangers lies outside the enclosed region.

7. Equipment according to claim 5, wherein an expansion device is provided between said another of said heat exchangers and said third one of said heat exchangers.

8. Heat pump equipment comprising at least three heat exchangers connected in a heat-exchange fluid circuit, one of which heat exchangers is intended to be located in an enclosed region and another of which is intended to be located outside the enclosed region, wherein a third one of the heat exchangers is arranged so that air which flows through an aperture in a wall which forms a boundary of the enclosed region, passes over the said third heat exchanger, wherein an expansion device is provided between the said another heat exchanger and the said third heat exchanger, and wherein a further expansion device is provided connected between the said third heat exchanger and the said one heat exchanger.

9. Equipment according to claim 8, further comprising air driving means to urge air to flow over the said third heat exchanger, the said driving means being reversible, so that air may be directed to flow from the interior of the enclosed region to the exterior of the enclosed region.

10. Equipment according to claim 8, wherein each expansion device is connected in parallel with an associated one-way valve, each allowing flow in a direction towards the said third heat exchanger.

11. Equipment according to claim 5, wherein a compressor is connected between said one of said heat exchangers and said another of said heat exchangers.

12. Equipment according to claim 11, wherein a reversing valve is connected between said compressor and both said one of said heat exchangers and said another of said heat exchangers.

13. Equipment according to claim 5, wherein an air filter is provided in said aperture.

* * * * *